US006193522B1

(12) United States Patent
Liao

(10) Patent No.: US 6,193,522 B1
(45) Date of Patent: Feb. 27, 2001

(54) SIGNAL ADAPTATION PLUG WITH ROTATABLE CONNECTOR

(76) Inventor: Sheng-Hsin Liao, No. 137, San Chun St., Shu Lin Jen Taipei Hsien (TW)

( * ) Notice: Subject to any disclaimer, the term of this patent is extended or adjusted under 35 U.S.C. 154(b) by 0 days.

(21) Appl. No.: 09/371,856

(22) Filed: Aug. 11, 1999

(51) Int. Cl.[7] ..... H01R 39/00; H01R 13/44; H01R 25/00; H01R 27/02; H01R 31/00

(52) U.S. Cl. ..... 439/31; 439/144; 439/640

(58) Field of Search ..... 439/11, 12, 13, 439/25, 31, 144, 344, 640

(56) References Cited

U.S. PATENT DOCUMENTS 5,658,152 * 8/1997 Selker ..... 439/31

5,679,013 * 10/1997 Matsunaga et al. ..... 439/144

* cited by examiner

*Primary Examiner*—Brian Sircus
*Assistant Examiner*—Chandrika Prasad
(74) *Attorney, Agent, or Firm*—Rosenberg, Klein & Lee

(57) ABSTRACT

A signal adaptation plug has a stage to which a rotatable connector is hinged on one side to be plugged into a socket at any angle. The stage has at least one accommodation groove. A rotatable cover plate is hinged to one side of the accommodation groove. A terminal assembly, composed of several pin terminals, is installed inside the stage. In use, the cover plate is angularly erected with respect to the stage, and the plug is plugged angularly between the accommodation groove and the cover plate. The connector of the signal adaptation plug is then plugged into a respective socket.

9 Claims, 8 Drawing Sheets

SIGNAL ADAPTATION PLUG WITH ROTATABLE CONNECTOR

FIELD OF THE INVENTION

The present invention relates to a signal adaptation plug, more particularly, to a signal adaptation plug with a stage which has a rotatable connector installed on one side and has at least one socket region.

BACKGROUND OF THE INVENTION

The specification of the plug and socket of each country may be different. A signal adaptation plug is thus needed. As shown in FIG. 9, the conventional signal adaptation plug 20 comprises four stages with respective accessories connected to each other. A stage is used as a socket 7*a*, which has several pin terminals installed inside. Another stage is used as a connector 8*a* to plug into the socket of an electronic equipment. The connector 8*a* has several pin terminals installed inside. The pin terminals of the socket 7*a* are connected to the pin terminals of the connector 8*a* through the lines 9*a*.

The conventional signal adaptation plug has at least two stages and two pin terminals, the production cost is thus increased. The two stages are connected through the lines, resulting in easy open-circuit or bad contact. Moreover, the signal adaptation plug can only provide one signal line for the connection of the plug, resulting in inconvenient usage.

The primary object of the present invention is to provide a signal adaptation plug which can be plugged on the socket at any angle and thus is not influenced by the environment.

The secondary object of the present invention is to provide a signal adaptation plug which is integrally formed and has a small volume. The manufacture and assembly is thus simple and convenient, and the production cost is reduced. Moreover, the signal adaptation plug of the present invention is dust-proof and can avoid bad contact.

One characteristic of the signal adaptation plug of the present invention is that it has a stage, which hinges a rotatable connector on one side. The connector may be of American, English, or other specification. The stage has at least an accommodation groove. A rotatable cover plate hinges on the stage and is situated on one side of the accommodation groove. A terminal assembly is composed of several pin terminals and is installed inside the stage. The pin terminal forms contact parts at the accommodation groove and the connector of the stage. The contact part of the pin terminal emerges from the stage. When the plug and the socket are not compatible, the cover plate is erected slantingly on the stage. The plug is plugged slantingly between the accommodation groove and the cover plate. The pin terminal of the plug contacts with the contact part of the pin terminal inside the stage. The connector of the signal adaptation plug is then plugged on the socket.

Another characteristic of the signal adaptation plug of the present invention is that A first and a second terminal assemblies are embedded inside the stage and the connector, respectively. The contact between the two terminal assemblies is of arc form. At least one terminal assembly is of spring form to let the two terminal assemblies stick tightly with each other by using resiliency. The two terminal assemblies will thus always contact with each other whenever the connector rotates.

The various objects and advantages of the present invention will be more readily understood from the following detailed description when read in conjunction with the appended drawing, in which:

DETAILED DESCRIPTION OF PREFERRED EMBODIMENT

Figure 1A:
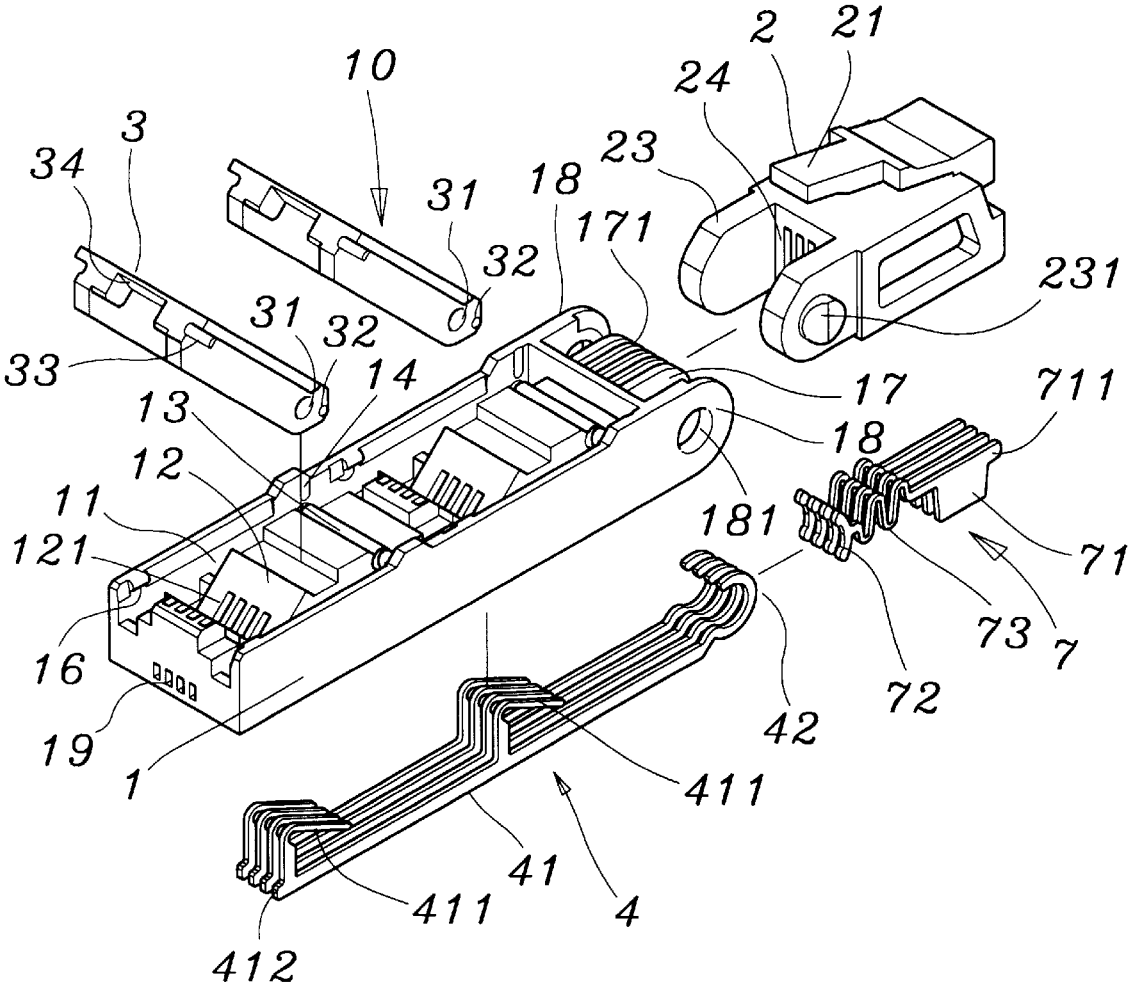
FIG. 1*a* is a perspective view of the signal adaptation plug of American specification according to the present invention.
Figure 2:
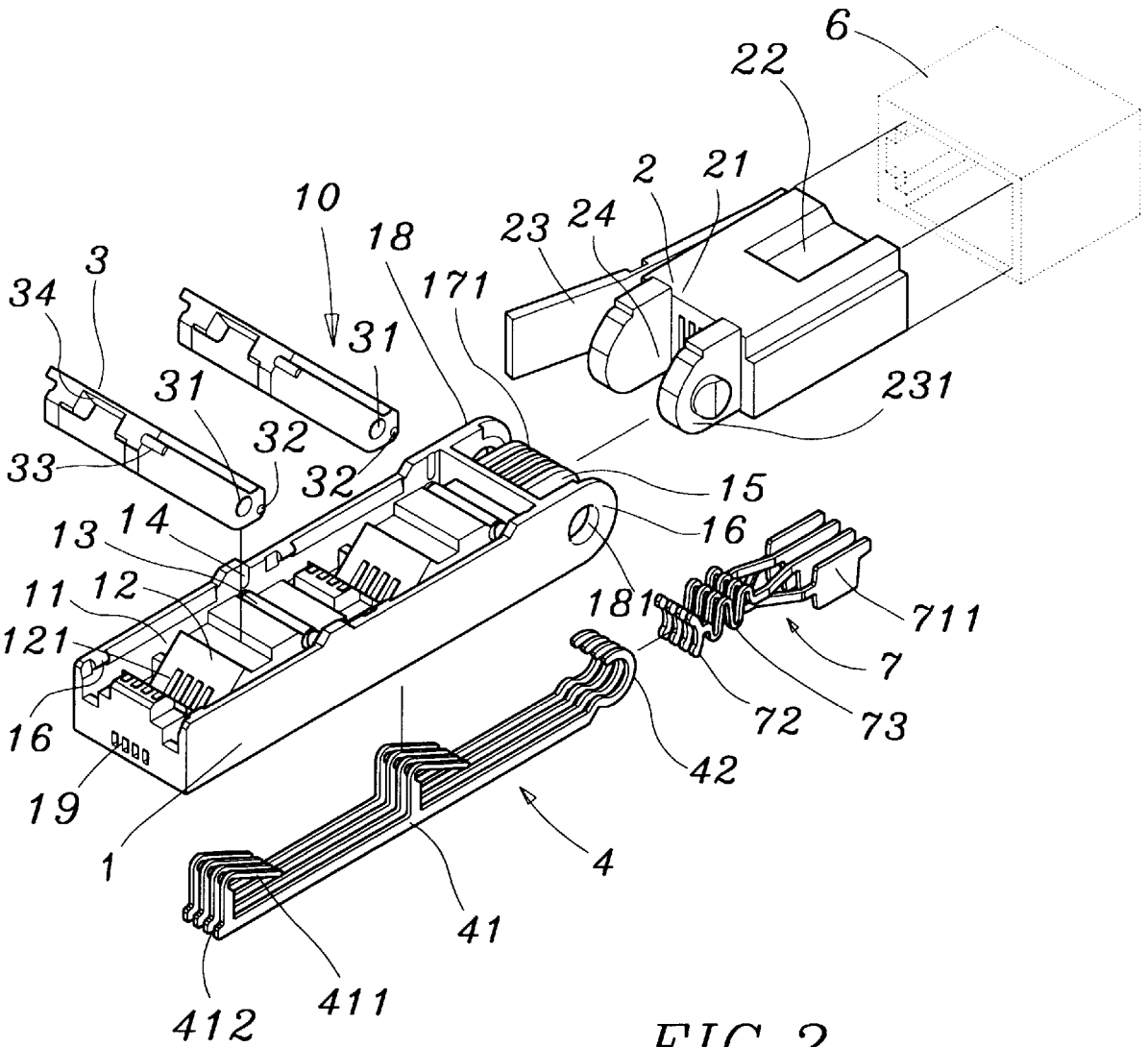
FIG. 2 is a perspective view of the signal adaptation plug of English specification according to the present invention.
Figure 4:
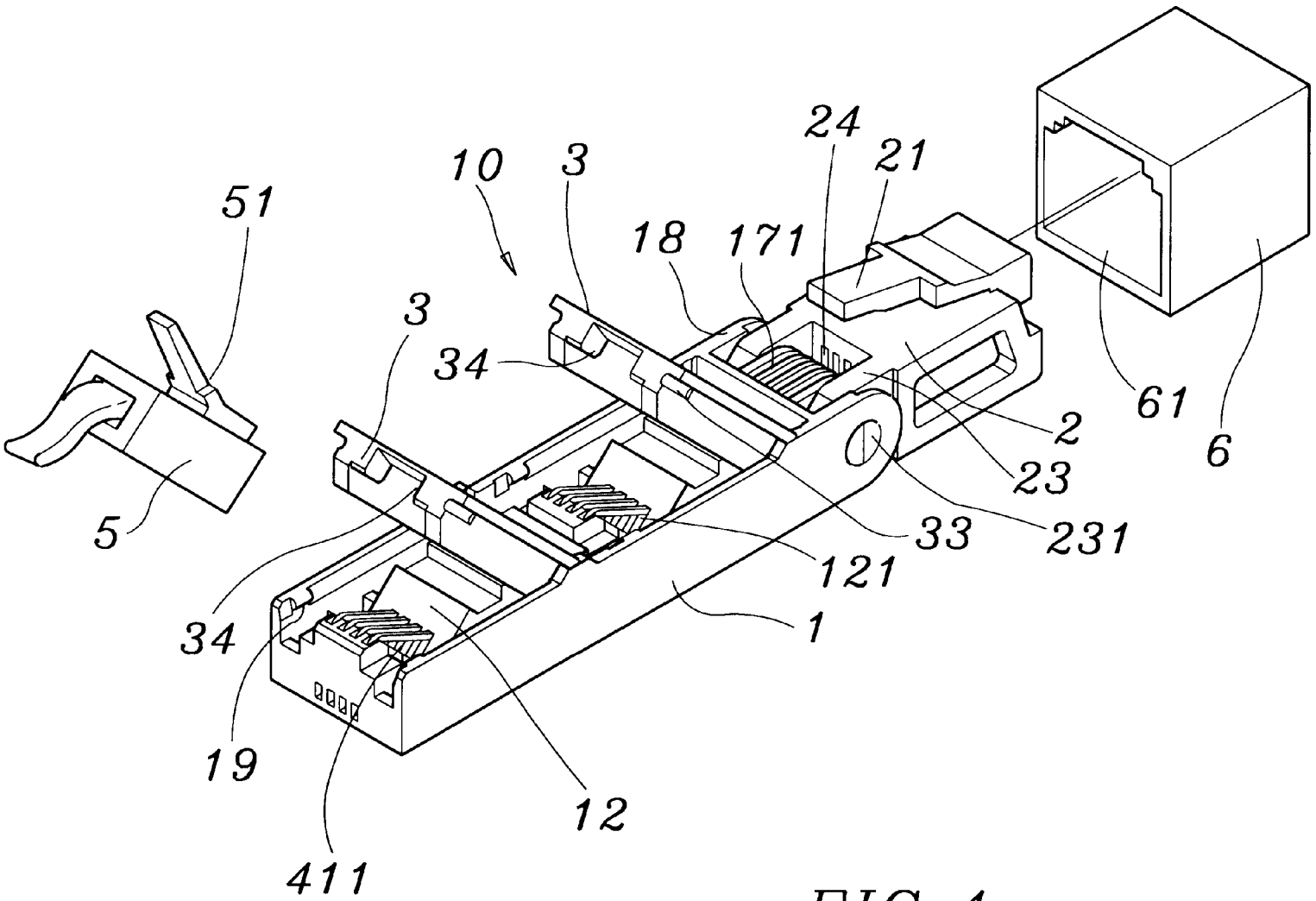
FIG. 4 is a perspective view showing the cover plate erected slantingly on the stage according to the present invention.

As shown in FIG. 1*a*, the signal adaptation plug 10 of the present invention has a stage 1 with a rotatable connector 2 formed on one side. The signal adaptation plug 10 is of American specification. The connector 2 has a lock part 21 on the top to lock inside the socket 6 (as shown in FIG. 4). As shown in FIG. 2, the signal adaptation plug 10 is of English specification. The connector 2 has a groove 22 formed on the top and has a lock part 21 on one side to lock inside the socket 6. The statements below all illustrate the signal adaptation plug of American specification.

Figure 1B:
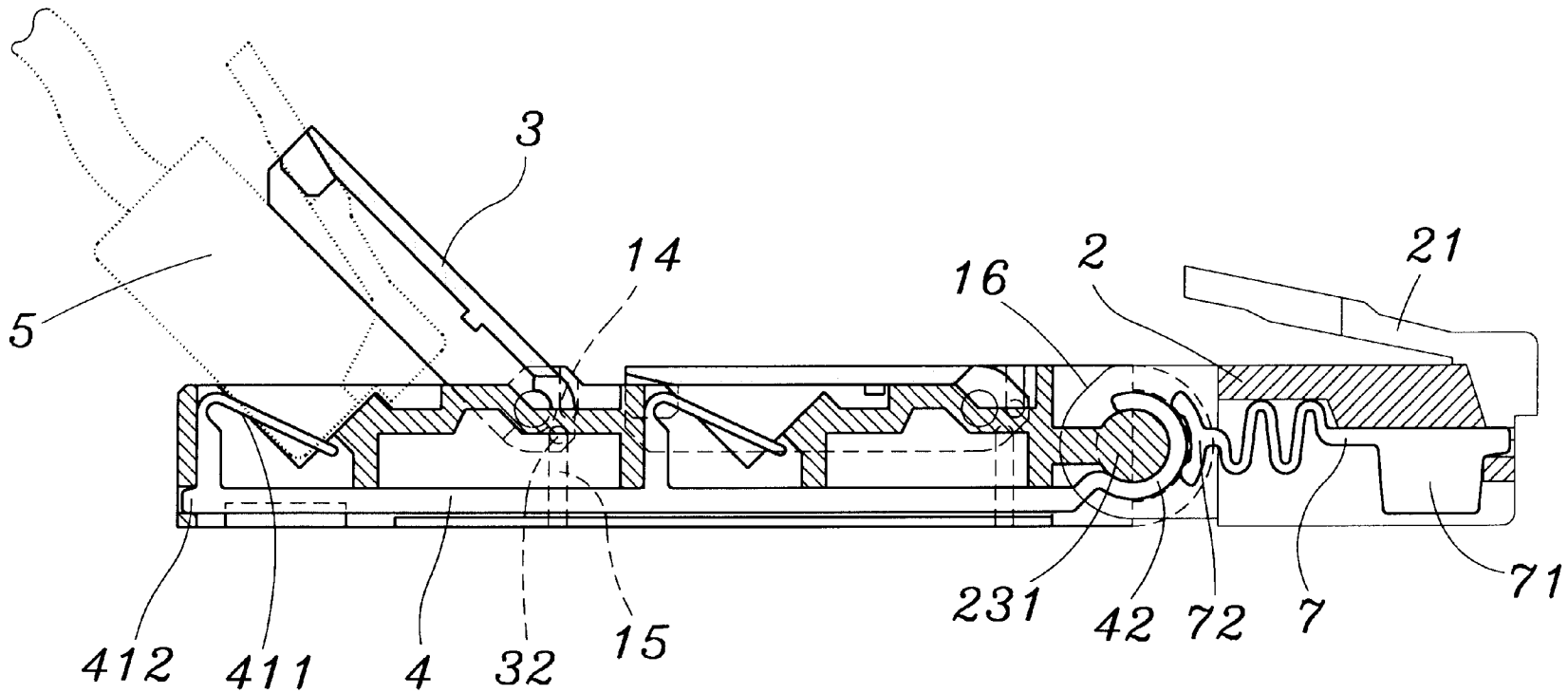
FIG. 1*b* is a cross section view of the stage according to the present invention.

As shown in FIG. 1*a* and 1*b*, the stage 1 has at least an accommodation groove 11 which has a slanting contact surface 12 with several gap grooves 121. One side of the accommodation groove 11 hinges a rotatable cover plate 3. The side of the cover plate 3 hinging the stage 1 has a hole 31 on each end. The vicinity of the hole 31 has a shaft 32. The place on the stage 1 corresponding to the hole 31 has a convex shaft 13. The two ends of the convex shaft 13 are locked in the holes 31 on the two ends of the cover plate 3. The two side wall of the stage 1 corresponding to the shaft 32 has a upper track 14 and a lower track 15. As shown in FIG. 1*b*, when the cover plate 3 is erected slantingly, the shaft 32 on the cover plate 3 is situated at the lower track 15. When the cover plate 3 covers levelly on the stages, the shaft 32 on the cover plate 3 is pushed upward to the upper track 14. The two sides of the cover plate 3 and substitute therefor the words not hinging the stage 1 have a lock groove 33. The corresponding place inside the stage 1 has a convex pole 16. The side of the cover plate 3 not hinging the stage 1 forms a concave groove 34 to connect the lock part 51 of the plug 5.

The side of the stage 1 hinging the connector 2 has a cylinder 17 with an arc end. The cylinder 17 has several embedding grooves 171. The stage 1 on the two side of the cylinder 17 extends to form a hinging plate 18. The hinging plate 18 has hinging holes 181. The side of the connector 2 corresponding to the stage 1 extends to form hinging plates 23. The outer side of the two hinging plates 23 has hinging shafts 231 to hinge the hinging holes of the stage 1. The connector 2 has several through holes 24 installed inside.

As shown in FIG. 1*a*, a first terminal assembly 4 contacts with a second terminal assembly 7. The first and the second terminal assembly is composed of several pin terminals 41 and 71, respectively. The first terminal assembly 4 is installed inside the stage 1, while the second terminal assembly 7 is installed inside the hole 24 of the connector 2. The terminal assembly 4 and 7 form respective contact parts 411 and 711 at the accommodation groove 11 of the stage 1 and the connector 2. The contact part 411 of the pin terminals 41 emerges from the gap groove 121 of the contact surface 12 of the stage 1. The terminal assembly 4 has a convex hook 412 on the tail end to be locked inside the lock groove 19 on the stage 1 when the first terminal assembly 4 is embedded inside the stage 1.

Figure 3:
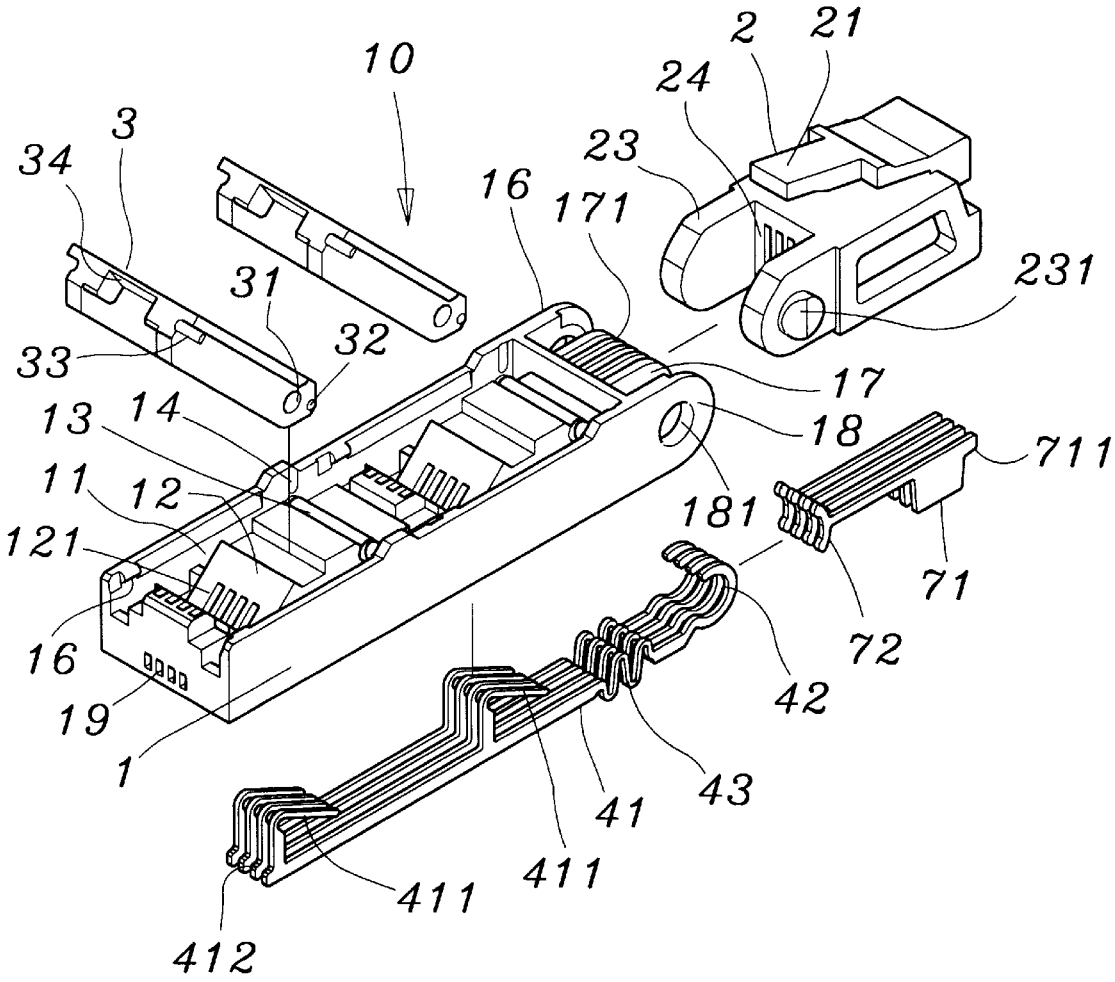
FIG. 3 is a perspective view of the signal adaptation plug according to another embodiment of the present invention.

According to a preferred embodiment of the present invention, the side of the first terminal assembly 4 contacting with the second terminal assembly 7 is of arc form 42 and is embedded inside the embedding groove 171 on the stage 1. The side of the second terminal assembly 7 contacting with the first terminal assembly 4 is of concave arc form 72 to always contact the second terminal assembly 7 with the first terminal assembly 4 when the connector 2 rotates with respect to the stage 1 to whatever angle. The pin terminals 71 of the second terminal assembly 7 is of spring form 73 to have resiliency. As shown in FIG. 3, the vicinity of the arc form 42 of the first terminal assembly 4 is an undulating portion 43 forming a spring to let the pin terminals 41 have resiliency. As shown in FIG. 2, the signal adaptation plug 10 of English specification can be used as the communication plug such as the plug for high-speed transmission. The contact part 711 of the second terminal assembly 7 is alternately arranged.

As shown in FIG. 4, when the user travels to the England, the plug 5 of American specification are not compatible with the local socket 6. The signal adaptation plug 10 of English specification shown on FIG. 2 can be used to connect the plug of American specification. When the cover plate 3 is switched upward, it rotates with the convex shaft 13 on the stage 1 as the axis. The shaft 32 on the cover plate 3 is pushed downward to the lower track 15 to let the cover plate 3 be erected slantingly on the stage 1. The lock part 51 of the plug 5 is then locked inside the concave groove 34 on the cover plate 3 to fix the plug 5 on the stage 1. The pin terminal of the plug 5 connects the first contact part 411 of the pin terminals 41 inside the stage 1. The connector 2 of the signal adaptation plug 10 is thus plugged on the socket 6.

When the signal adaptation plug 10 is not used, the cover plate 3 is rotated with the convex shaft 13 on the stage 1 as the axis. The shaft 32 on the cover plate 3 is pushed upward to the upper track 14 to let the cover plate 3 cover on the stage 1. The convex pole 16 of the stage 1 will be embedded inside the lock groove 33 on the other side of the cover plate 3. The cover plate 3 is thus fixed on the stage 1.

Figure 5:
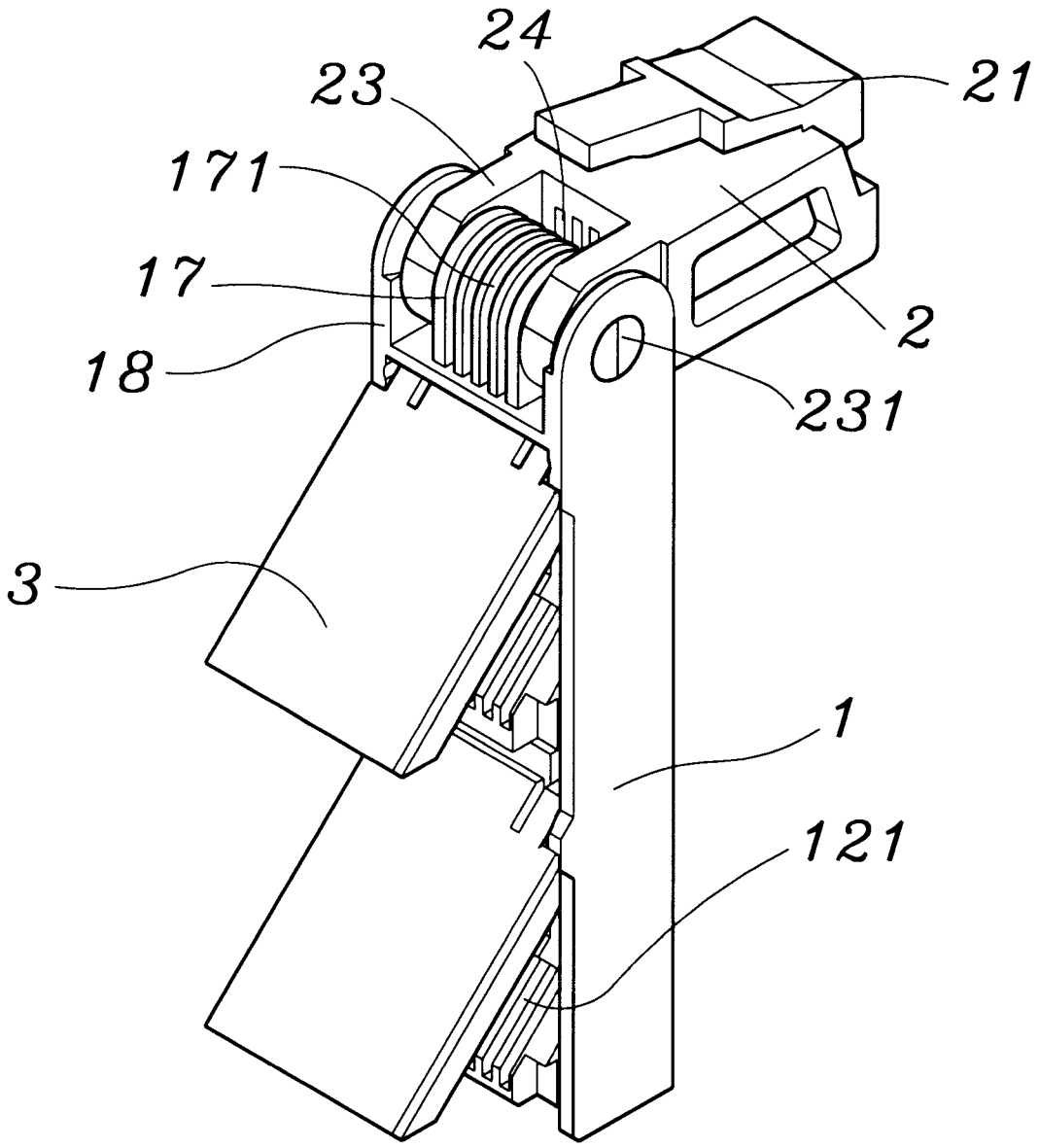
FIG. 5 is a perspective view showing the connector perpendicular to the socket according to the present invention.

As shown in FIG. 5, when the signal adaptation plug 10 is influenced by the environment and can not be plugged on the socket 6, or when the direction of the plug 5 is to be changed, or when the signal adaptation plug 10 is rotated from transverse to longitudinal plugging direction to reduce the space needed, the connector 2 can be rotated with respect to the hinging shaft 231 to a desirable angle. The connector 2 is rotated to be perpendicular to the stage 1 in this embodiment. The usage convenience is thus increased. When the signal adaptation plug 10 is detached from the socket 6, the connector 2 is rotated to be parallel to the signal adaptation plug 10.

Figure 6:
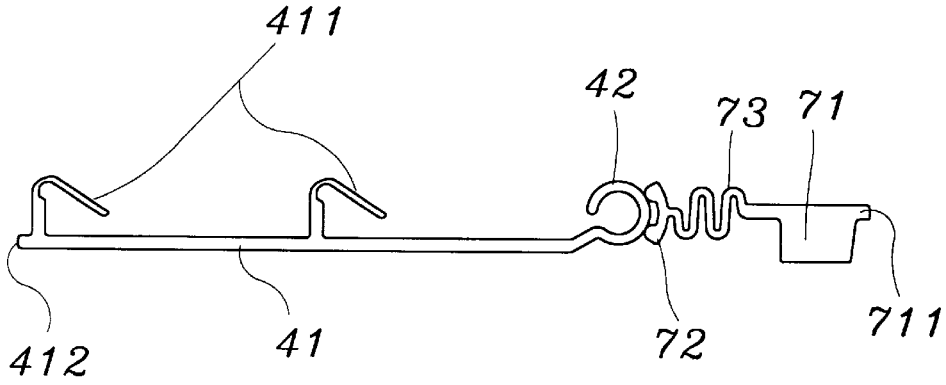
FIG. 6 is a perspective view showing two terminal assemblies contacted with each other according to the present invention.
Figure 7:
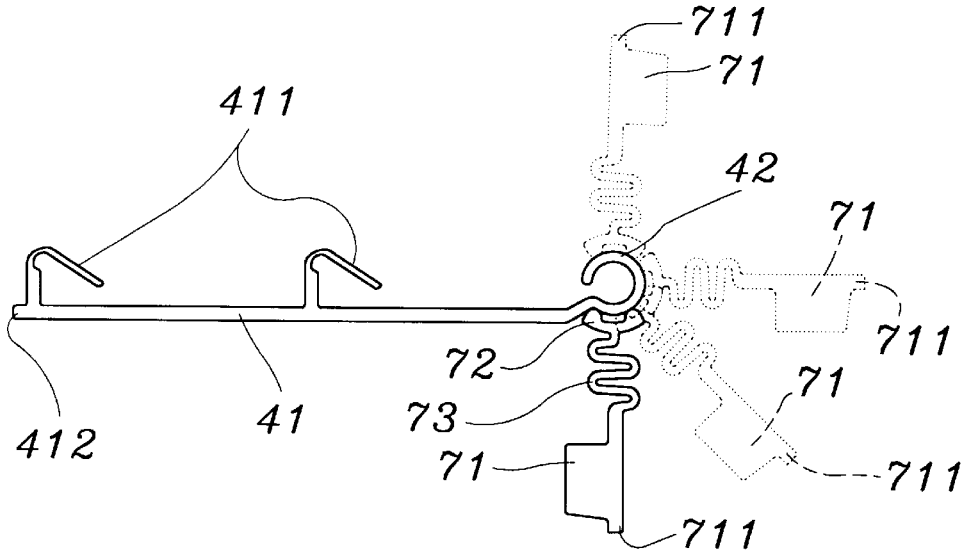
FIG. 7 is a perspective view showing the operation of two terminal assemblies according to the present invention.
Figure 8:
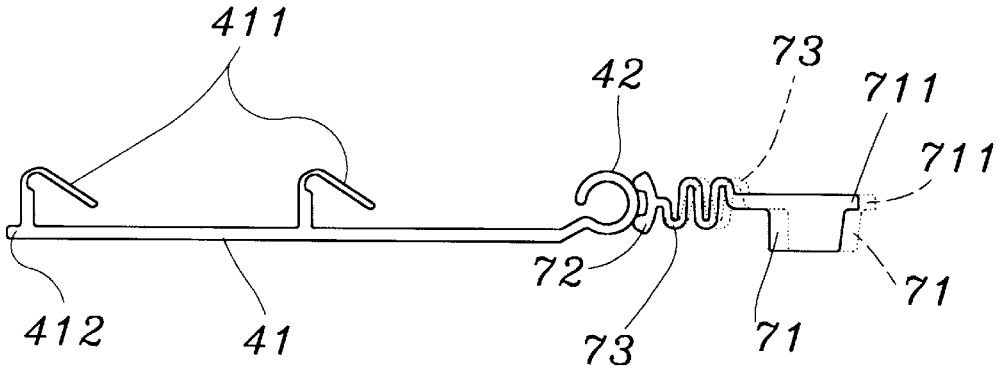
FIG. 8 is another perspective view showing the operation of two terminal assemblies according to the present invention.
Figure 9:
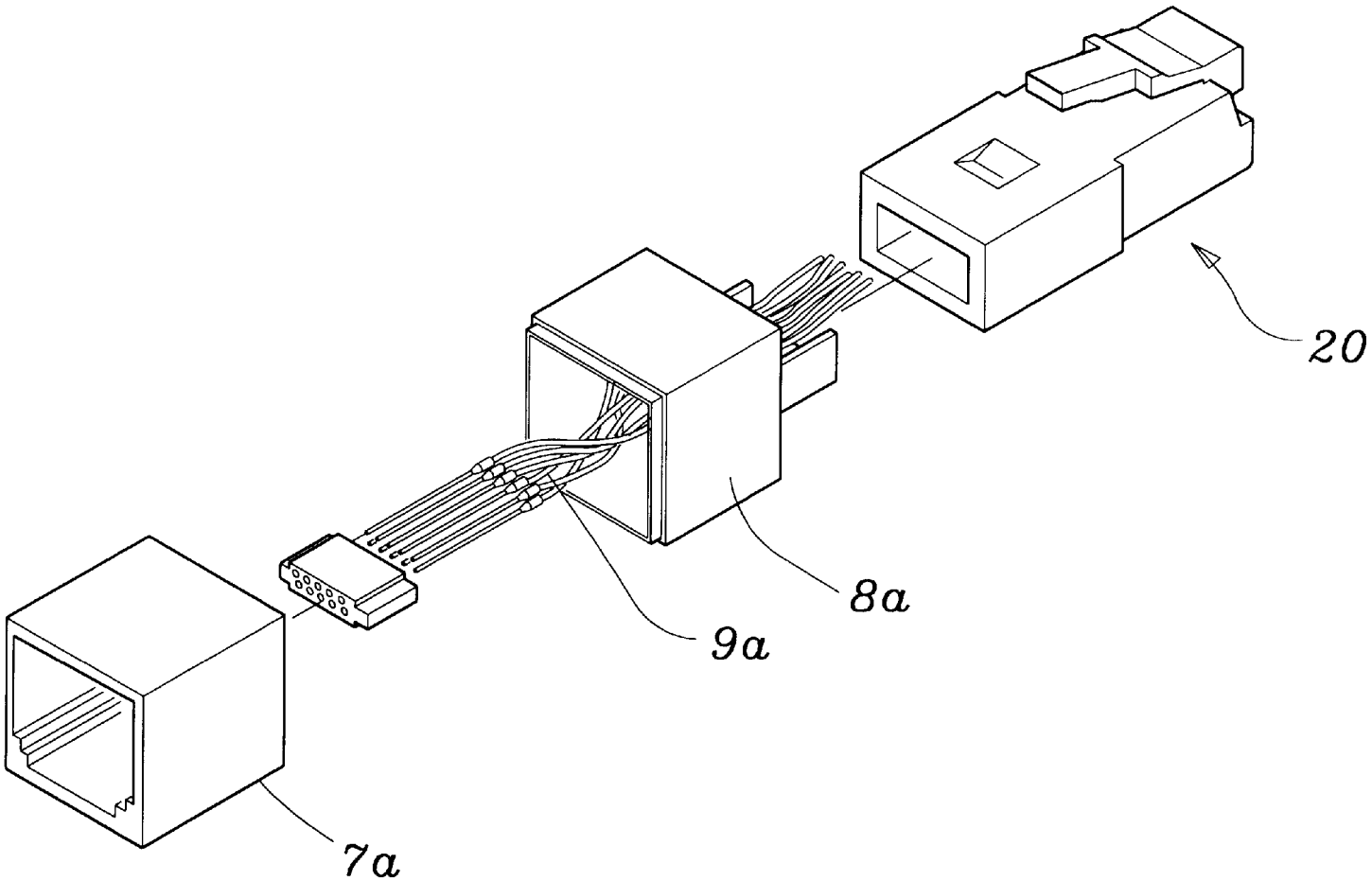
FIG. 9 PRIOR ART
FIG. 9 is a perspective view of the conventional signal adaptation plug.

As shown in FIGS. 6 and 7, the sides of the first terminal assembly 4 and the second terminal assembly 7 contacting with the each other are both of arc form. The second terminal assembly 7 will thus always contact with the first terminal assembly 4 when the connector 2 rotates with respect to the stage 1 to whatever angle. As shown in FIG. 8, the pin terminals of the second terminal assembly 7 has an undulating portion forming a spring. The second terminal assembly 7 having spring 73 can stick tightly to the first terminal assembly 4 by using resiliency. The two terminal assemblies 4 and 7 will thus always contact with each other whenever the connector 2 rotates.

To sum up, the connector 2 can rotate with respect to the stage 1 to plug the signal adaptation plug 10 on the socket 6 at whatever angle. The influence of the environment is eliminated. The signal adaptation plug of 10 is integrally formed and has a small volume, the manufacture and assembly is thus simple and convenient. The production cost is also reduced. Moreover, the signal adaptation plug of the present invention is dust-proof and can avoid bad contact.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A signal adaption plug, comprising:

a longitudinally extended stage having at least one accommodation groove formed in said stage, said accommodation groove having a contact surface formed therein, said contact surface having a plurality of gap grooves formed therein, said stage having a pair of transversely directed lower tracks respectively formed in opposing side walls bordering said accommodation groove and a pair of transversely directed upper tracks respectively formed in opposing side walls bordering said accommodation groove and spaced from said lower tracks;

a connector having a proximal end rotatively coupled to one end of said stage and adapted for releasable coupling with a socket;

at least one cover plate having a first end hingedly coupled to said stage and being situated on one side of said accommodation groove, said cover plate being reversably positionable from a first position levelly covering said accommodation groove to an angularly directed second position for releasable engagement with a locking member of a plug received within said accommodation groove, said cover plate having a pair of shafts extending from opposing sides thereof, said pair of shafts being respectively disposed in said upper tracks when said cover plate is in said first position, said pair of shafts being respectively displaced to said lower tracks when said cover plate is displaced to said second position for holding said cover plate in said second position;

a first terminal assembly composed of a plurality of first pin terminals and installed inside said stage, said plurality of first pin terminals each having at least one first contact part in said accommodation groove, said first contact part of each of said plurality of first pin terminals passing through a respective gap groove of the contact surface of said accommodation groove; and, a second terminal assembly composed of a plurality of second pin terminals and installed inside said connector, said plurality of second pin terminals each having a second contact part in said connector and emerging therefrom.

2. The signal adaption plug as in claim 1, wherein said connector includes a lock part formed on a top portion for releasable engagement with a corresponding portion of the socket.

3. The signal adaption plug as in claim 1, wherein said cover plate has a pair of lock grooves formed on opposing sides thereof adjacent a second end of said cover plate, said stage having a pair of convex poles respectively formed on an inside surface of said side walls in correspondence with said pair of lock grooves for latching said cover plate in said first position.

4. The signal adaption plug as in claim 1, wherein said end of said stage rotatively coupling said connector has a cylinder with an arcuately shaped end, said plurality of first pin terminals each having an arcuate contact portion formed on an end thereof, said cylinder having a plurality of embedding grooves formed therein through which said arcuate contact portions of said plurality of first pin terminals of said first terminal assembly respectively pass.

5. The signal adaptation plug as in claim 4, wherein each of said plurality of second pin terminals has a concave arcuate end portion formed thereon, said connector having a plurality of through holes formed therein adjacent said proximal end for respectively receiving said concave arcuate end portions of said plurality of second pin terminals of said second terminal assembly therein to respectively contact said arcuate contact portions of said plurality of first pin terminals.

6. The signal adaption plug as in claim 5, wherein each said second pin terminal of said second terminal assembly has an undulating portion forming a resilient spring to maintain said contact between said concave arcuate end portion and a corresponding one of said arcuate contact portions.

7. The signal adaption plug as in claim 5, wherein each said first pin terminal has an undulating portion forming a resilient spring to maintain said contact between said arcuate contact portion and a corresponding one of said concave arcuate end portions.

8. A signal adaption plug, comprising:

a longitudinally extended stage having at least one accommodation groove formed in said stage, said accommodation groove having a contact surface formed therein, said contact surface having a plurality of gap grooves formed therein;

a connector having a proximal end rotatively coupled to one end of said stage and adapted for releasable coupling with a socket;

at least one cover plate having a first end hingedly coupled to said stage and being situated on one side of said accommodation groove, said cover plate being reversably positionable from a first position levelly covering said accommodation groove to an angularly directed second position for releasable engagement with a locking member of a plug received within said accommodation groove;

a first terminal assembly composed of a plurality of first pin terminals and installed inside said stage, said plurality of first pin terminals each having at least one first contact part in said accommodation groove, said first contact part of each of said plurality of first pin terminals passing through a respective gap groove of the contact surface of said accommodation groove, said plurality of first pin terminals each having an arcuate contact portion formed on an end thereof and extending from said stage; and, a second terminal assembly composed of a plurality of second pin terminals and installed inside said connector, said plurality of second pin terminals each having a second contact part on one end thereof disposed in said connector and extending therefrom and a concave arcuate end portion formed on an opposing end of said second pin terminal, said concave arcuate end portion of each said second pin terminal extending from said proximal end of said connector for respectively contacting a corresponding one of said arcuate contact portions of said plurality of first pin terminals, each said second pin terminal having an undulating portion forming a resilient spring to maintain said contact between said concave arcuate end portion and a respective one of said arcuate contact portions.

9. A signal adaption plug, comprising:

a longitudinally extended stage having at least one accommodation groove formed in said stage, said accommodation groove having a contact surface formed therein, said contact surface having a plurality of gap grooves formed therein;

a connector having a proximal end rotatively coupled to one end of said stage and adapted for releasable coupling with a socket;

at least one cover plate having a first end hingedly coupled to said stage and being situated on one side of said accommodation groove, said cover plate being reversably positionable from a first position levelly covering said accommodation groove to an angularly directed second position for releasable engagement with a locking member of a plug received within said accommodation groove;

a first terminal assembly composed of a plurality of first pin terminals and installed inside said stage, said plurality of first pin terminals each having at least one first contact part in said accommodation groove, said first contact part of each of said plurality of first pin terminals passing through a respective gap groove of the contact surface of said accommodation groove, said plurality of first pin terminals each having an arcuate contact portion formed on an end thereof and extending from said stage; and, a second terminal assembly composed of a plurality of second pin terminals and installed inside said connector, said plurality of second pin terminals each having a second contact part on one end thereof disposed in said connector and extending therefrom and a concave arcuate end portion formed on an opposing end of said second pin terminal, said concave arcuate end portion of each said second pin terminal extending from said proximal end of said connector for respectively contacting a corresponding one of said arcuate contact portions of said plurality of first pin terminals, each said first pin terminal having an undulating portion forming a resilient spring to maintain said contact between said arcuate contact portion and a respective one of said concave arcuate end portions.

* * * * *